US008182436B2

(12) United States Patent
Zhong

(10) Patent No.: US 8,182,436 B2
(45) Date of Patent: May 22, 2012

(54) MASSAGE DEVICE

(75) Inventor: Jianhong Zhong, Dongguan (CN)

(73) Assignee: Chichun Wu, Dongguan, Guangdong (CN)

( * ) Notice: Subject to any disclaimer, the term of this patent is extended or adjusted under 35 U.S.C. 154(b) by 1010 days.

(21) Appl. No.: 11/946,173

(22) Filed: Nov. 28, 2007

(65) Prior Publication Data

US 2008/0146978 A1 Jun. 19, 2008

(30) Foreign Application Priority Data

Nov. 29, 2006 (CN) ..... 200620148179

(51) Int. Cl.
*A61H 7/00* (2006.01)

(52) U.S. Cl. ..... 601/84; 601/86; 601/88; 601/98; 601/99; 601/115

(58) Field of Classification Search ..... 601/1, 84, 601/86, 87, 94, 98–103, 112–116
See application file for complete search history.

(56) References Cited

U.S. PATENT DOCUMENTS

| | | | | |
|---|---|---|---|---|
| 2,107,449 | A * | 2/1938 | Marlowe | 601/36 |
| 4,526,163 | A * | 7/1985 | Fedders | 601/112 |
| 5,685,827 | A | 11/1997 | Shimizu | |
| 6,183,429 | B1 | 2/2001 | Dervieux | |
| 7,128,721 | B2 * | 10/2006 | Ferber et al. | 601/86 |
| 7,597,669 | B2 * | 10/2009 | Huang | 601/86 |
| 2004/0049136 | A1 | 3/2004 | Lin | |
| 2004/0106882 | A1 | 6/2004 | Tseng | |
| 2006/0211962 | A1 | 9/2006 | Ferber et al. | |
| 2007/0106185 | A1 * | 5/2007 | Ferber et al. | 601/86 |

FOREIGN PATENT DOCUMENTS

| | | | |
|---|---|---|---|
| DE | 20218728 | U1 | 3/2003 |
| EP | 1595521 | A1 | 11/2005 |

* cited by examiner

*Primary Examiner* — Justine Yu
*Assistant Examiner* — Latoya M Louis
(74) *Attorney, Agent, or Firm* — Morris Manning & Martin LLP; Tim Tingkang Xia, Esq.

(57) ABSTRACT

A massage device includes a motor, a body mechanism and a massage mechanism. The body mechanism includes a faceplate, a soleplate, a massage transmission assembly and a move transmission assembly which are disposed between the faceplate and the soleplate. The massage mechanism fixed to the body mechanism includes at least one massage head, a massage assembly and a massage-head transmission assembly. The transmission of the massage device is through the engagement of the worm, the worm wheel, the massage transmission assembly, the gears, the gear rack, the planetary gear and the central gear. Such transmission enables the massage head to make four kinds of motions at the same time to achieve a variety of massage effects, change the intensity of strength and vary the massage position continuously in a larger region.

14 Claims, 3 Drawing Sheets

MASSAGE DEVICE

FIELD OF THE INVENTION

This application claims priority of Chinese Patent Application No. 200620148179.6, filed Nov. 29, 2006 and incorporated herein by reference in its entirety.

The present invention relates to a fitness equipment, and more particularly to a massage device which can achieve a variety of massage effects.

BACKGROUND OF THE INVENTION

Conventional massage devices mostly utilize contacts or mechanisms called massage heads provided thereon to act on a specific part of a human body, thereby achieving some massage effects, such as periodical shocking, beating or kneading. However, the massage effects just act on the human body in a certain position and the massage motions are single and monotonous, which is unable to meet the massage demands of the different configurations of different parts and a larger area of the same part of the human body, so there are many drawbacks and limitations in these conventional massage devices.

The present applicant formerly applied for a Chinese patent application called a massage device structure (Application No. 02250262.9). By providing a transmission mechanism, a pair of massage heads consisting of a higher massage head and a lower massage head, and an engagement of a gear and a rack, the massage-heads can make three kinds of motions at the same time, thereby changing the intensity of strength and the massage position constantly at a certain larger region when massaging, to achieve an imitated manual massage effect. But the motions of the massage-heads which have three kinds of motions are still felt unvaried and single. Furthermore, the scope that the massage-heads can extend is still not enough.

In view of the defects of prior-art health care massage devices and based on the rich practical experience and professional knowledge, the applicant has researched and innovated actively, improved continually, tested repeatedly, and finally created this invention with practical value.

SUMMARY OF THE INVENTION

Accordingly, an object of the present invention is to provide a new massage device to overcome the defects in the conventional massage device. The technical problem to be solved is to provide a massage device which is capable of changing the intensity of massage strength and massage position continuously and having the massage-heads make four movements synchronously.

Another object of the present invention is to provide a new massage device having a particular massage-head transmission assembly to permit massage heads thereof to perform massage in a larger scope.

To achieve the above-mentioned object, a massage device according to one aspect of the present invention comprises a motor, a body mechanism, and a massage mechanism. The body mechanism comprises a faceplate, a soleplate, a massage transmission assembly and a move transmission assembly which are disposed between the faceplate and the soleplate. The massage mechanism comprises at least a massage head, a massage assembly and a massage-head transmission assembly, and the massage mechanism is fixed to the body mechanism.

As an embodiment of the present invention, the massage transmission assembly comprises a worm, a double-worm wheel consisting of a worm wheel and a gear, an idler wheel, a shaft, and a gearwheel. The worm is fastened to a drive shaft of the motor. The worm wheel of the double-worm wheel engages with the worm. The gear of the double-worm wheel engages with the idler wheel. The idler wheel engages with the gearwheel, and the gearwheel is fixed to the shaft.

As an embodiment of the present invention, the move transmission assembly comprises a pinion, a double-gear consisting of a smaller gear and a larger gear, a move double-gear, and a rack. The pinion is fixed to the shaft and engages with the larger gear of the double-gear. The smaller gear of the double-gear engages with the move double-gear. The move double-gear engages with the rack.

As an embodiment of the present invention, the massage-head transmission assembly comprises a planetary gear, a planetary gear shaft and a central gear. The planetary gear is fixed to the planetary gear shaft, and the central gear is fixed to the shaft and engages with the planetary gear.

As an embodiment of the present invention, the massage assembly comprises a massage-head bracket and a rotating bracket. The rotating bracket is fixed to the shaft. The massage heads and the massage-head bracket are mounted to the rotating bracket rotationally through the planetary gear shaft, and the massage-head bracket is fixed to the planetary gear shaft.

As an embodiment of the present invention, the massage-head mechanism comprises a higher massage head and a lower massage head, the massage heads are mushroom-shaped, the higher and lower massage heads are mounted on the massage-head bracket in pairs and located at opposite sides of the planetary gear shaft.

A massage device according to another aspect of the present invention comprises a motor, a body mechanism, and a massage mechanism. The body mechanism comprises a faceplate, a soleplate, and a massage transmission assembly disposed between the faceplate and the soleplate. The massage mechanism comprises at least one massage head, a massage assembly to load the massage head, and a massage-head transmission assembly which comprises a central gear and a planetary gear engaging with the central gear. The motor drives the massage transmission assembly. The massage transmission assembly drives the central gear together with the massage assembly, the massage head and the planetary gear to rotate around a central axis of the central gear. The central gear drives the planetary gear together with the massage head to rotate around a central axis of the planetary gear.

Based on the foregoing technical solution, the massage device of the present invention at least has the following advantages:

1) The transmission of the massage device is through the engagement of the worm, the worm wheel, the massage transmission assembly, the gears, the gear rack, the planetary gear and the central gear. Such transmission enables the massage heads to make four kinds of motions at the same time to achieve a variety of massage effects, change the intensity of strength while massaging and vary the massage position continuously in a larger region.
2) The users can adjust and control the massage position of the massage device and change the massage mode according to different needs, thus to achieve comfortable massage effects of gentle massage and different parts massage.
3) The massage device structure is simple and is very easy to assemble and carry.

In summary, the present invention has many advantages and practical value as mentioned above. It makes a great improvement both in product structure and function and has a great progress in technology. It gets a handy and practical result and has more promotional and outstanding efficacies compared with the conventional massage device, thus it is more suitable for practice. Therefore, the present invention is a novel, improved and practical design.

The foregoing description of the present invention is only a summarization of the technical solution of the present invention. In order to make the technical solution of this invention more apparent and make it be able to be implemented according to the specification, and in order to make the aforementioned and other objects, features and advantages of the present invention more understandable, an preferred embodiment of the invention with reference to the drawings is selected to illustrate principles of the present invention detailed below.

DETAILED DESCRIPTION OF ILLUSTRATED EMBODIMENTS

Figure 1:
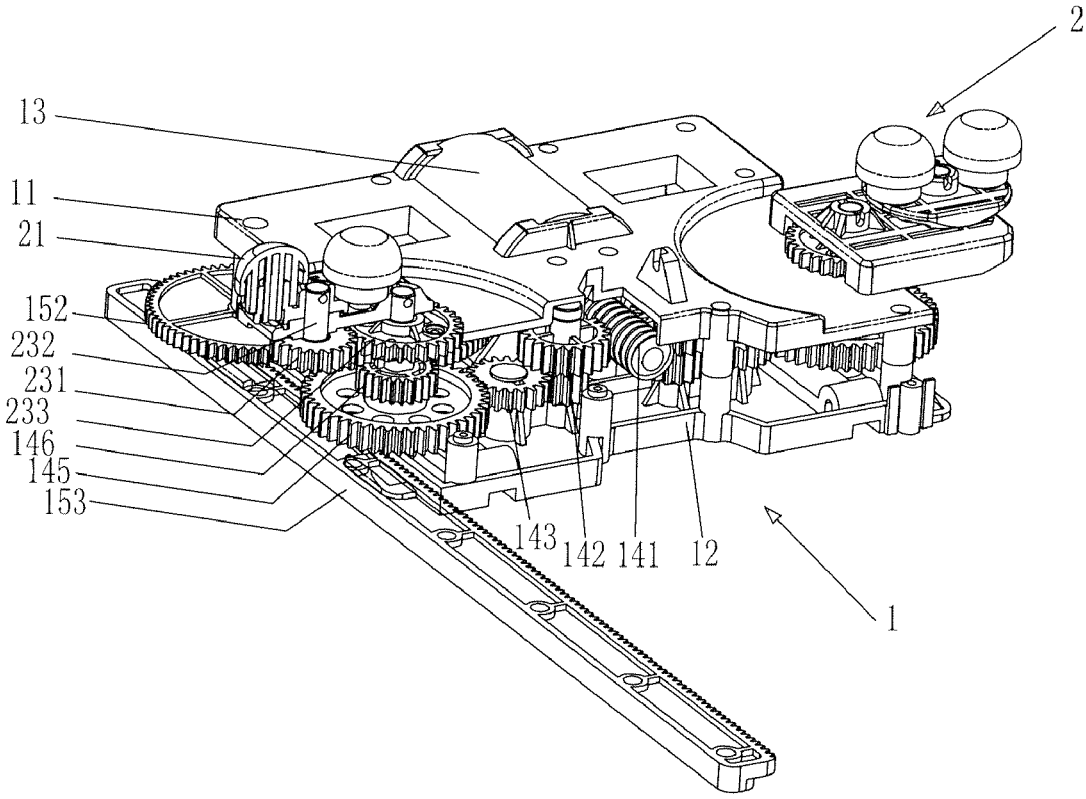
FIG. 1 is an assembled perspective view of a massage device according to an embodiment of the present invention.

In order to expatiate the technical solution to achieve the objects of the present invention further, an explanatory embodiment of the present invention and its features and advantages will now be described with reference to the figures, wherein like reference numerals designate similar parts throughout the various views.

Figure 2:
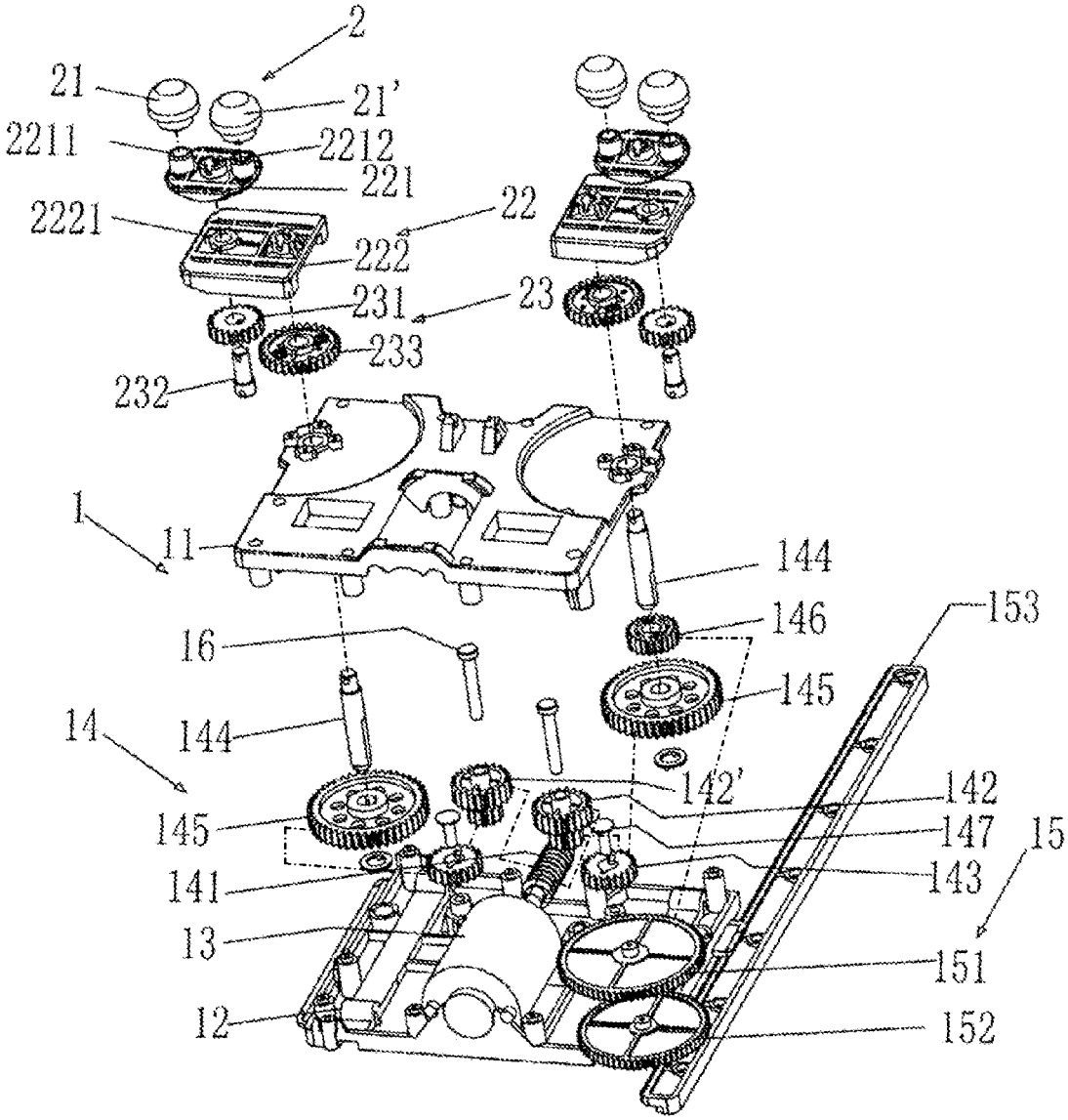
FIG. 2 is an exploded view of the massage device of the present invention shown in FIG. 1.
Figure 3:
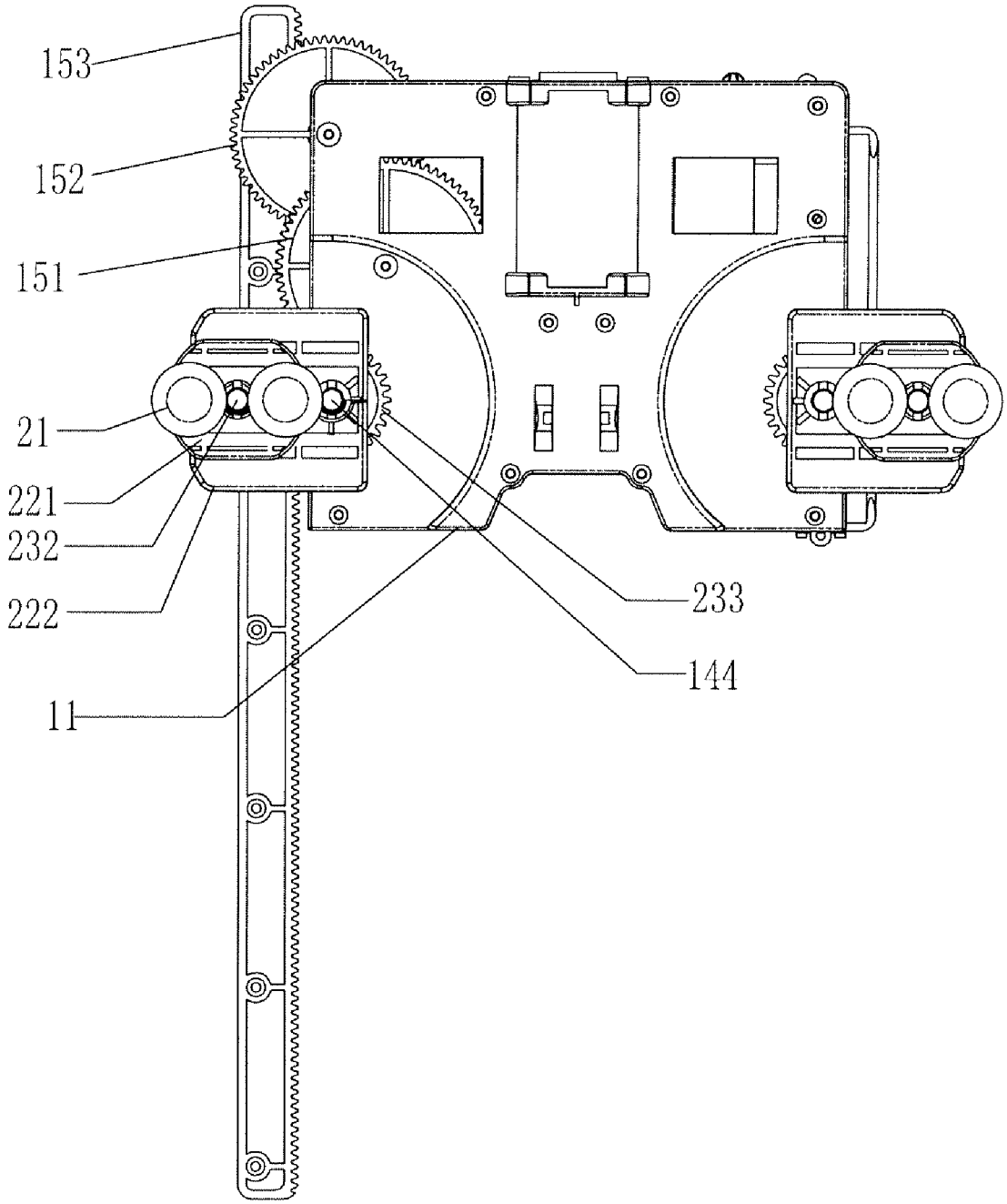
FIG. 3 is a plan view of the massage device of the present invention shown in FIG. 1.

Referring to FIGS. 1-3, the massage device of the present invention at least includes a body mechanism 1 and a massage mechanism 2. The body mechanism 1 includes a faceplate 11, a soleplate 12, a motor 13, a massage transmission assembly 14, a move transmission assembly 15, and several setscrews 16. The motor 13, the massage transmission assembly 14, and the move transmission assembly 15 are disposed between the faceplate 11 and the soleplate 12. The setscrews 16 are used to assemble all the components aforementioned of the massage device together. The massage transmission assembly 14 includes a worm 141, a double-worm wheel 142/142' consisting of a worm wheel and a gear, an idler wheel 143, a shaft 144, and a gearwheel 145. The worm 141 is fastened to a drive shaft of the motor 13. The worm wheel of the double-worm wheels 142/142' engages with the worm 141. The gear of the double-worm wheel 142/142' engages with the idler wheel 143. The idler wheel 143 engages with the gearwheel 145, and the idler wheel is fixed to the soleplate 12 by a screw 147. The gearwheel 145 is fastened to the shaft 144. The faceplate 11 is fastened to the soleplate 12 by the setscrews 16.

The move transmission assembly 15 includes a pinion 146, a double-gear 151 consisting of a smaller gear (not shown) and a larger gear, a move double-gear 152, and a rack 153. The pinion 146 is fixed to the shaft 144 and engages with the larger gear of the double-gear 151. The smaller gear of the double-gear 151 engages with the move double-gear 152. The move double-gear 152 engages with the rack 153.

The massage mechanism 2 includes a higher massage head 21 and a lower massage head 21' which are mushroom-shaped, a massage assembly 22 and a massage-head transmission assembly 23. The massage mechanism 2 is fixed to the body mechanism 1 though the shaft 144. The higher massage head 21 and the lower massage head 21' are respectively mounted to two center holes 2211 which locate at opposite sides of the massage-head bracket 221 and the massage heads can rotate by themselves. The massage-head transmission assembly 23 includes a planetary gear 231, a planetary gear shaft 232 and a central gear 233. The planetary gear 231 is fixed to the planetary gear shaft 232. The central gear 233 is fixed to the shaft 144 and engages with the planetary gear 231. The massage assembly 22 includes a massage-head bracket 221 and a rotating bracket 222. The rotating bracket 222 is fixed to the shaft 144. The massage heads 21, 21' and the massage-head bracket 221 are mounted to the rotating bracket 222 rotationally through the planetary gear shaft 232, and the massage-head bracket 221 is fixed to the planetary gear shaft 232.

By providing the transmission mechanism, the higher and the lower massage heads, and the engagement of the gears and racks, the massage heads of the present invention can make four kinds of motions at the same time as followed:

(1) The first action: the higher and the lower massage heads 21, 21' are mounted to the holes 2211 located at opposite sides of the massage-head bracket 221 and the massage heads are able to rotate by themselves.

(2) The second action: the massage-head bracket 221 with the higher and lower massage-heads 21, 21' mounted thereon rotates around the planetary gear shaft 232 which extends through a center hole 2221 of the rotating bracket 222 and is fixed to the middle shaft hole 2212 of the massage-head bracket 221. Namely, the massage-head bracket 221 together with the higher and lower massage-heads 21, 21' rotates around the central axis of the planetary gear 231.

(3) The third action: the rotating bracket 222 on which the higher and the lower massage heads 21, 21' and the massage-head bracket 221 are mounted rotates around the shaft 144 fixed to the central gear 233 and the gearwheel 145. That is, the higher and the lower massage heads 21, 21' and the massage-head bracket 221 rotate around the central axis of the central gear 233.

(4) The fourth action: the move board (it comprises the faceplate 12 and the soleplate 11) with the higher and lower massage heads 21, 21' mounted thereon moves horizontally along the rack 153 back and forth.

The operation processes of the massage heads are described below:

(1) The running of the motor 13 drives the running of the worm 141. The worm 141 engages with the worm wheels of the double-worm wheels 142, 142' (one in the left side, the other in the right side). The gear of the double-worm wheel engages with the idler wheel 143, and the idler wheel 143 engages with the gearwheel 145. Thus, the running of the motor 13 will cause the rotating of the gearwheel 145.

(2) The gearwheel 145 is mounted on the soleplate 12 at a corresponding position through the shaft 144. The pinion 146 and the rotating bracket 222 are fixed to the shaft 144. The rotating of the gearwheel 145 drives the shaft 144, the pinion 146, the central gear 233 and the rotating bracket 222 which are fixed to the shaft 144 to rotate. The rotating of the rotating bracket 222 causes the rotating of the massage-head bracket 221 and the higher and the lower massage heads 21, 21' (the third action aforementioned).

(3) With the rotating of the central gear 233, the planetary gear 231, which engages with the central gear 233, and the planetary gear shaft 232 rotate. On account of the fastening of the planetary gear shaft 232 and the massage-head bracket 221, the rotating of the planetary gear shaft 232 causes the rotating of the massage-head bracket 221 with the higher and lower massage-heads 21, 21' mounted thereon (the second action aforesaid).

(4) The rotating of the gearwheel 145 causes the drive shaft 144 and the pinion fastened to the shaft 144 to rotate. The pinion 146 engages with the larger gear of the double-gear 151, thereby causes the rotating of the move double-gear 152 which engages with the smaller gear of the double-gear 151. The move double-gear 152 engages with the rack 153. This makes the move board (it is composed of the faceplate 12 and the soleplate 11) on which the higher and the lower massage heads 21, 21' are mounted to move horizontally along the rack 153 back and forth (the fourth action foregoing).

The first action of the massage-heads is a kind of free movement. The control of the second, the third, and the fourth actions can use the control system disclosed in the Chinese Patent No. 200620139314.0 which is applied for by the present applicant, and incorporated herein by reference in its entirety.

The foregoing description of the present invention has been presented for purposes of illustration and description. It is not intended to be exhaustive or to limit the invention to the precise form disclosed, and many modifications and variations are possible in light of the above teaching. Such modifications and variations that may be apparent to those skilled in the art are intended to be included within the scope of this invention as defined by the accompanying claims.

What is claimed is:

1. A massage device comprising:

a motor;

a body mechanism; and a massage mechanism;

wherein the body mechanism comprises a faceplate, a soleplate, and a massage transmission assembly disposed between the faceplate and the soleplate, the massage mechanism comprises a central gear coaxially fixed to a first shaft of the massage transmission assembly, a first bracket directly fastened to the first shaft, a planetary gear engaged with the central gear, a second shaft coaxially connected to the planetary gear and rotatably mounted on the first bracket, a central axis of the second shaft being substantially parallel to and displaced from the axis of the central gear, a second bracket directly fastened to the second shaft and at least one massage head mounted on the second bracket, the at least one massage head being displaced from the central axis of the second shaft;

wherein, in operation, the motor drives the massage transmission assembly, the massage transmission assembly drives the central gear causing the first bracket to rotate around the axis of the central gear, the central gear drives the planetary gear causing the second bracket to rotate around a central axis of the planetary gear, thereby providing a double rotary kneading effect to a body of a user.

2. The massage device according to claim 1, wherein the massage transmission assembly comprises a worm, a double-worm wheel consisting of a worm wheel and a gear, an idler wheel, the first shaft, and a gearwheel, the worm is fastened to a drive shaft of the motor, the worm wheel of the double-worm wheel engages with the worm, the gear of the double-worm wheel engages with the idler wheel, the idler wheel engages with the gearwheel, and the gearwheel and the central gear are fixed to the first shaft.

3. The massage device according to claim 1, wherein the at least one massage head comprises a higher massage head and a lower massage head, wherein each of the higher massage head and the lower massage head is mushroom-shaped, the higher and the lower massage heads are located at opposite sides of the second shaft on the second bracket.

4. A massage device comprising: a rack, a motor, a body mechanism, and a massage mechanism, wherein the body mechanism comprises a move board comprising a faceplate and a soleplate; a massage transmission assembly; and a move transmission assembly, wherein the massage transmission assembly and the move transmission assembly are disposed between the faceplate and the soleplate, wherein the massage mechanism comprises a central gear coaxially fixed to a first shaft of the massage transmission assembly, a first bracket directly fastened to the first shaft, a planetary gear engaged with the central gear, a second shaft coaxially connected to the planetary gear and rotatably mounted on the first bracket, a central axis of the second shaft being substantially parallel to and displaced from the axis of the central gear, a second bracket directly fastened to the second shaft and at least one massage head mounted on the second bracket, the at least one massage head being displaced from the central axis of the second shaft, wherein, in operation, the motor drives simultaneously the move transmission assembly and the massage transmission assembly, the massage transmission assembly drives the central gear causing the first bracket to rotate around the axis of the central gear, the central gear drives the planetary gear causing the second bracket to rotate around a central axis of the planetary gear, and the move transmission assembly causes the move board to move back and forth along the rack, thereby providing a double rotary kneading effect to various parts of a body of a user.

5. The massage device of claim 4, wherein the at least one massage head comprises two massage heads.

6. The massage device according to claim 5, wherein the massage transmission assembly comprises a worm, a double-worm wheel comprising a worm wheel and a gear, an idler wheel, the first shaft, and a gearwheel, wherein the worm is fastened to a drive shaft of the motor, the worm wheel of the double-worm wheel engages with the worm, the gear of the double-worm wheel engages with the idler wheel, the idler wheel engages with the gearwheel, and the gearwheel is fixed to the first shaft.

7. The massage device according to claim 6, wherein the move transmission assembly comprises a pinion, a double-gear comprising a smaller gear and a larger gear, and a move double-gear, wherein the pinion is fixed to the first shaft and engages with the larger gear of the double-gear, the smaller gear of the double-gear engages with the move double-gear, and the move double-gear engages with the rack.

8. The massage device according to claim 4, wherein the massage transmission assembly comprises a worm, a double-worm wheel comprising a worm wheel and a gear, an idler wheel, the first shaft, and a gearwheel, wherein the worm is fastened to a drive shaft of the motor, the worm wheel of the double-worm wheel engages with the worm, the gear of the double-worm wheel engages with the idler wheel, the idler wheel engages with the gearwheel, and the gearwheel is fixed to the first shaft.

9. The massage device according to claim 8, wherein the move transmission assembly comprises a pinion, a double-gear comprising a smaller gear and a larger gear, and a move double-gear, wherein the pinion is fixed to the first shaft and engages with the larger gear of the double-gear, the smaller gear of the double-gear engages with the move double-gear, and the move double-gear engages with the rack.

10. A massage device, comprising:

(a) a carriage having a base plate and a cover plate;

(b) a motor mounted on the base plate;

(c) a massage transmission assembly engaged with the motor and disposed between the base plate and the cover plate; and (d) at least one massage assembly protruding from the cover plate, the at least one massage assembly comprising:

(i) a first gear engaged with the massage transmission assembly, an axis of the first gear being substantially perpendicular to the cover plate;

(ii) a first shaft coaxially connected to the first gear;

(iii) a first bracket directly fastened to the first shaft;

(iv) a second gear engaged with the first gear, an axis of the second gear being substantially parallel to and displaced from the axis of the first gear;

(v) a second shaft having a first end and a second, opposite end, the second shaft being coaxially connected to the second gear at the first end thereof and rotatably mounted on and extends through the first bracket;

(vi) a second bracket directly fastened to the second shaft at the second end thereof; and (vii) at least one massage head mounted on and protruding from the second bracket, the at least one massage head being displaced from an axis of the first shaft;

wherein, in operation, the motor drives the massage transmission assembly, the massage transmission assembly drives the first gear causing the first bracket to rotate about the axis of the first gear, and the first gear drives the second gear causing the second bracket to rotate about the axis of the second gear, thereby providing a double rotary kneading effect to a body of a user.

11. The massage device of claim 10, wherein the at least one massage assembly comprises two massage assemblies symmetrically positioned on two lateral sides of the carriage.

12. The massage device of claim 10, wherein the at least one massage head comprises two massage heads positioned at opposite sides of the second shaft on the second bracket.

13. The massage device of claim 12, wherein each of the two massage heads has a mushroom shape and is rotatable about an axis thereof.

14. The massage device of claim 10, further comprising a translation mechanism and a track, wherein the translation mechanism is engaged with the motor and the track such that, in operation, the motor drives the translation mechanism causing the carriage to move along the track, thereby providing massaging to various parts of the body of the user.

* * * * *